US007546062B2

(12) United States Patent
Ohanyan

(10) Patent No.: US 7,546,062 B2
(45) Date of Patent: Jun. 9, 2009

(54) METHODS AND APPARATUS FOR REMANUFACTURING TONER CARTRIDGES

(75) Inventor: Tigran Ohanyan, Burbank, CA (US)

(73) Assignee: Future Graphics Imaging Corporation, San Fernando, CA (US)

( * ) Notice: Subject to any disclaimer, the term of this patent is extended or adjusted under 35 U.S.C. 154(b) by 256 days.

(21) Appl. No.: 11/598,964

(22) Filed: Nov. 14, 2006

(65) Prior Publication Data

US 2008/0112724 A1 May 15, 2008

(51) Int. Cl.
*G03G 15/00* (2006.01)

(52) U.S. Cl. ..... 399/109; 399/117

(58) Field of Classification Search ..... 399/107, 399/109, 110, 111, 116, 117
See application file for complete search history.

(56) References Cited

U.S. PATENT DOCUMENTS 5,729,795 A * 3/1998 Kavolius et al. ..... 399/109
6,499,924 B2 * 12/2002 Kilian et al. ..... 411/176
7,346,292 B2 3/2008 Williams et al.
2007/0025759 A1 2/2007 William et al.
2008/0159780 A1 7/2008 Wiliams et al.

* cited by examiner

*Primary Examiner*—Hoan H Tran
(74) *Attorney, Agent, or Firm*—Lewis Brishois Bisgaard & Smith, LLP; Roland Tong

(57) ABSTRACT

A method of removing a drum from a printer toner cartridge, the drum having a cylindrical body, the drum further having a pair of drum gears attached to each end of the drum, each drum gear being configured to attach the drum to the printer, at least one drum gear having a cylindrical body, the cylindrical body defining a hollow drum gear interior, at least one drum gear further having a drum gear wall that is positioned perpendicular to the cylindrical body and configured to cover the hollow drum gear interior, the method including the steps of creating a hole through the drum gear wall and inserting a cutting device through the hollow drum gear interior.

9 Claims, 9 Drawing Sheets

METHODS AND APPARATUS FOR REMANUFACTURING TONER CARTRIDGES

CROSS REFERENCES TO RELATED APPLICATIONS

None

FIELD OF INVENTION

The present invention relates to electrophotography, particularly methods and apparatus for remanufacturing toner cartridges.

BACKGROUND

Used printer cartridges of fax machines, copiers, inkjet printers, and laser printers are often remanufactured. Generally, printers embed toner on paper by relying on electrical charges occurring within the printer cartridges. Printer cartridges typically include a toner hopper, a primary charge roller, and a drum. The toner is typically stored in the toner hopper and carries a negative charge. The drum is typically given a charge by a primary charge roller or PCR. The charge of the drum is typically more positive than the charge of the toner, and thus the drum is able to attract the toner. Once the drum is given a charge by the PCR and a print pattern is set, the drum gets coated with toner. The drum that is coated with toner then rolls over a sheet of paper, which is usually given a negative charge by the PCR. The charge of the paper is less negative than the charge of the toner, and thus the paper attracts the toner. The toner is embedded on the paper according to the print pattern.

The drum is usually one of the components that wears out from usage and gets replaced during remanufacturing. In some cartridges, such as those manufactured by Hewlett Packard company having model numbers HP 1600, HP 2600, and HP 2605, the drums are attached to the cartridges in a manner that makes the drums difficult to remove from the cartridges and may require breaking the cartridges. It is desirable to be able to detach the drums from the cartridges without having to break the parts of the cartridges. This helps preserve the appearance of the cartridges and minimizes remanufacturing steps. Methods and apparatus for efficiently and quickly detaching the drums from the cartridges are desired and are addressed by the present invention.

BRIEF DESCRIPTION OF THE PREFERRED EMBODIMENTS OF THE PRESENT INVENTION

The present invention includes a method of removing a drum from a printer toner cartridge, the drum comprising a cylindrical body, the drum further comprising a pair of drum gears attached to each end of the drum, each gear being configured to attach the drum to the printer, at least one gear comprising a cylindrical body, the cylindrical body defining a hollow gear interior, at least one gear further comprising a gear wall that is positioned perpendicular to the cylindrical body and configured to cover the hollow gear interior, the method comprising creating a hole through the gear wall and inserting a cutting device through the hollow gear interior.

The present invention also comprises a cutting device for use in detaching a drum from a printer cartridge, the cutting device comprising a shaft; a recess defined by the shaft; a cutter arm moveably attached to the shaft; a pointed edge integral with the cutter arm, the pointed edge being moveable in and out of the recess; and an actuator attached to the cutter arm, the actuator being configured to move the cutter arm and cause the pointed edge to move in and out of the recess, wherein when the pointed edge is out of the recess, the pointed edge is configured to cut the drum free from the printer cartridge.

The above description sets forth, rather broadly, a summary of embodiments of the present invention so that the detailed description that follows may be better understood and contributions of the present invention to the art may be better appreciated. Some of the embodiments of the present invention may not include all of the features or characteristics listed in the above summary. There may be, of course, other features of the invention that will be described below and may form the subject matter of claims. In this respect, before explaining at least one embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways.

DESCRIPTION OF THE PREFERRED EMBODIMENTS

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention. Also, it is to be understood that the phraseology and terminology employed herein are for the purpose of description and should not be regarded as limiting.

The order in which the steps are presented below is not limited to any particular order and does not necessarily imply that they have to be performed in the order presented. It will be understood by those of ordinary skill in the art that the order of these steps can be rearranged and performed in any suitable manner. It will further be understood by those of ordinary skill in the art that some steps may be omitted or added and still fall within the spirit of the invention.

Figure 1:
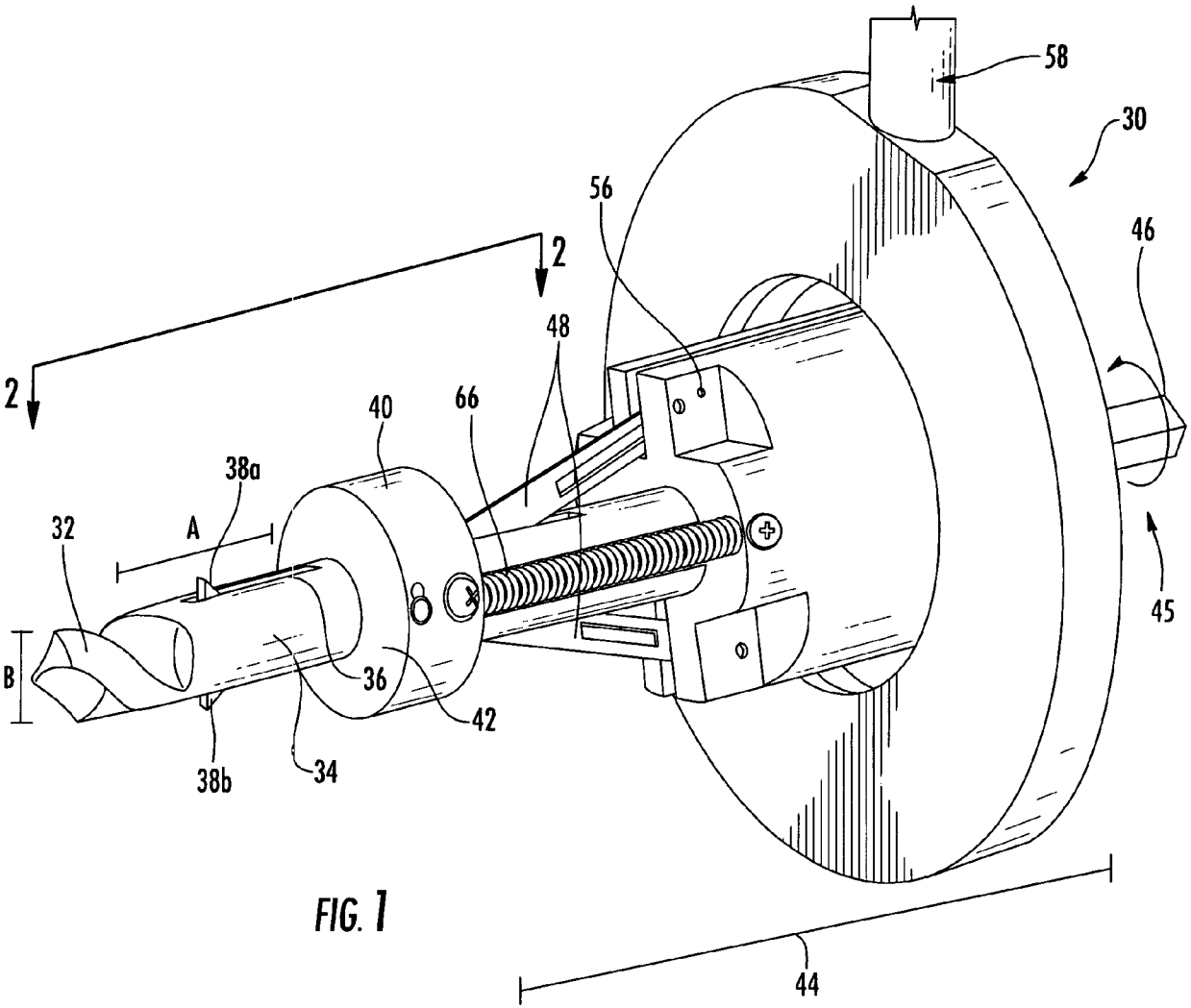
FIG. 1 is substantially a perspective view of an embodiment of a cutting tool of the present invention.

Referring to FIG. 1, the present invention includes a cutting device 30. The cutting device 30 preferably includes a drill end 32. The drill end 32 is preferably configured to be rotated to make a hole on a part of a drum gear, which is a structure that connects the drum to the printer and allows the drum to rotate when the printer is in operation (not shown). Cutting device 30 preferably also includes a drill shaft 34 extending from a non-pointed side of the drill end 32. The drill shaft 34 preferably defines a horizontal plane A and a vertical plane B. The drill shaft 34 preferably defines a recess 36 extending from side to side or laterally. The recess 36 preferably lies on the horizontal plane A. The height of the recess 36 preferably spans the entire vertical plane B of the drill shaft 34.

A pair of moveable cutting edges 38*a* and 38*b* is preferably positioned to move in and out of the recess 36. The pair of movable cutting edges 38*a* and 38*b* is preferably positioned to move in the direction that is opposite to each other's direction of movement. Each cutting edge 38 preferably includes a structure with substantially pointed edge, as shown in FIG. 1. The level of the sharpness or the dullness of the pointed edge may be varied depending on the efficiency of the cutting and the smoothness of the cut surface the user desires. The number and position of the cutting edges around the shaft may also be varied.

Cutting device 30 preferably further includes a stop collar 40 attached to a portion of the drill shaft 34 where the recess 36 runs. The stop collar 40 preferably surrounds the outer surface of the drill shaft 34 and covers a portion of the recess 36. The stop collar 40 preferably rotates with the drill shaft 34. The stop collar 40 is shown to be circular in shape in FIG. 1. However, the stop collar 40 may be designed with various shapes.

The position of the stop collar 40 on the drill shaft 34 is preferably adjacent to the cutting edges 38*a* and 38*b* and in between an actuating mechanism 44 and the cutting edges 38*a* and 38*b*. The stop collar 40 preferably includes a stop surface 42, which is preferably substantially flat and configured to abut a part of the cartridge (not shown). The distance between the cutting edges 38*a* and 38*b* and the stop collar 40 is preferably predetermined depending on where on the drum or the drum gear the cutting device is designed to make the cut. Once the location of the cut is determined, the distance between the location of the cut and the part of the cartridge to which the stop surface 42 will abut can be calculated. The calculated distance may be used in positioning the stop collar 40 on the drill shaft 34. That is, the calculated distance may be used as the distance between the cutting edges 38*a* and 38*b* and the position of the stop surface 42 on the drill shaft 34. It can be realized that the cutting device 30 of the present invention provides a way to cut in a manner where the location of the cut may be adjusted and may be determined with precision.

The drill shaft 34 and the recess 36 therein preferably extend sideways past the location of the stop collar 40. Substantially adjacent to the stop collar 40 and substantially opposite the drill end 32 on the drill shaft 34 is preferably an actuating mechanism 44 for the cutting edges 38*a* and 38*b*, which is discussed further below. The drill shaft 34 preferably includes an end 45 opposite the drill end 32, which preferably includes a drill attachment tip 46 attached thereto. The drill attachment tip 46 preferably includes a non-circular periphery such that an electric drill (not shown) may easily grasp the tip 46 and electrically rotate the drill shaft 34.

Figure 2:
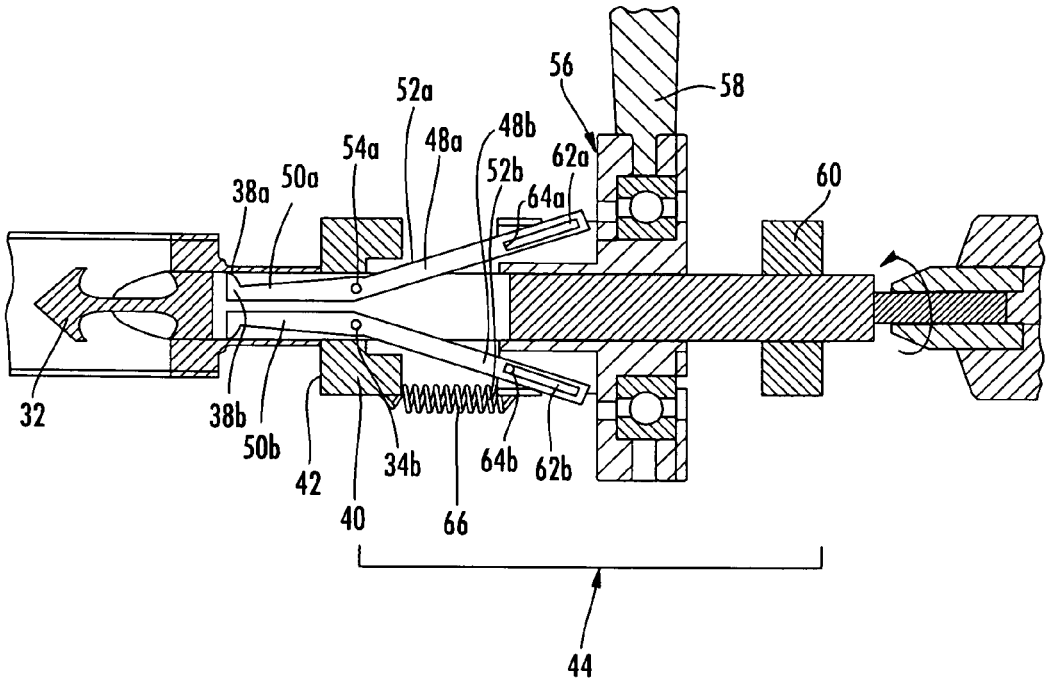
FIG. 2 is substantially a cross-sectional view of the cutting tool shown in FIG. 1.

With reference now to FIG. 2, the actuating mechanism 44 for the cutting edges 38*a* and 38*b* is shown and preferably includes cutter arms 48*a* and 48*b*, arm actuation device 56, actuation device handle 58, and actuation device stop collar 60. Each cutting edge 38*a* and 38*b* is preferably integral to or a part of a corresponding cutter arm 48*a* and 48*b*. Each cutter arm 48 preferably includes a first component 50*a* or 50*b*, which is preferably positioned within the confines of the drill shaft 34.

First components 50*a* and 50*b* preferably extend to their respective second components 52*a* or 52*b*, which are preferably positioned at an angle relative to the first components 50*a* and 50*b*. In the preferred embodiment, the second component 52 is preferably at an angle between 90-180 degrees from the first component 50. Substantial portions of the second components 52 preferably project out of the confines of the drill shaft 34 through the recess 36. Each cutter arm 48 is preferably attached to the drill shaft 34 via a mechanical pin 54*a* or 54*b* positioned within the confines of the recess 36 and attached to the interior wall of the drill shaft 34. Each cutter arm 48 may preferably pivot around its respective mechanical pin 54.

With continued reference to FIG. 2, each second component 52 of the cutter arm 48 is preferably moveably attached to the arm actuating device 56 from an end that is distal and opposite from the cutting edges 38. Each of said second component end preferably defines a lateral recess 62*a* and 62*b* extending from side to side. The arm actuating device 56 preferably attaches to each second component via a mechanical pin 64*a* or 64*b* that passes through the recess 62*a* or 62*b* and that is attached to the arm actuating device 56. The mechanical pin 64 is preferably configured to slide within the recess 62 when the actuating device 56 is operated to activate the cutting edges 38.

The actuating device 56 is preferably a structure that defines a cylindrical recess configured to accommodate the drill shaft 34. The drill shaft 34 is preferably inserted through this cylindrical recess to allow the actuating device 56 to slide sideways on the drill shaft 34. The actuating device may be made with various shapes. The actuating device 56 is preferably attached to one end of a biasing device 66. The other end of the biasing device 66 is preferably attached to the stop collar 40. It can be realized from FIG. 2 that the actuating device 56 is preferably biased to move toward the stop collar 40 in the deactivated position. In the deactivated position, the biasing device 66 also positions the actuating device 56 and the mechanical pin 64 toward the stop collar 40. First component 50*a* is preferably biased to pivot counterclockwise. First component 50*b* is preferably biased to pivot clockwise. In other words, in the deactivated position, cutter arms 48*a* and 48*b* are biased to pivot toward each other. As a result, the cutting edges 38*a* and 38 are preferably positioned to be contained inside the confines of the drill shaft 34 when the actuating device 56 is deactivated.

With continued reference to FIG. 2, an actuation device stop collar 60 that wraps around and is attached to the drill shaft 34 may be provided to limit the sliding distance of the actuating device 56. The actuating device 56, the stop collar 60, and the stop collar 40 preferably wrap around the drill shaft 34 rotates with the drill shaft 34. The actuation device stop collar 60 is preferably positioned on the drill shaft 34 at a predetermined distance relative to the actuating device 56. The predetermined distance is preferably based on the desired maximum height of the cutting edge 38 when the cutting device 30 will be operated. The height of the cutting edge 38 that will project out of the recess 36 is directly proportional to the distance between the actuation device stop collar 60 and the actuating device 56. It can be realized that the height of the cutting edge 38 from the drill shaft 34 determines the depth of the cut created by the cutting edge 38.

Figure 3:
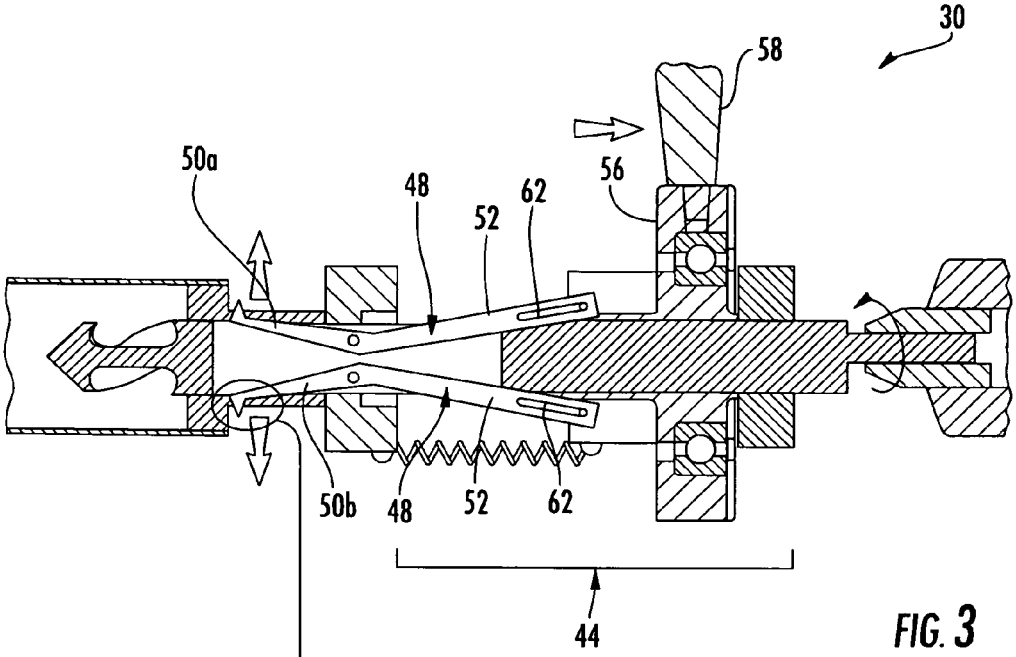
FIG. 3 is substantially a cross-sectional view of the cutting tool shown in FIG. 1, the cutting edges being shown to be actuated.

Referring now to FIG. 3, the actuating mechanism 44 may be activated as follows. A user may hold a handle 58 attached to the actuating device 56 and pull said handle 58 towards the stop collar 60 as indicated by the arrow. The handle 58 preferably includes an elongate body and a circular body attached thereto, which is preferably configured to surround the actuating device 56. The periphery of the actuating device 56 is preferably attached to the circular body, such that when the handle 58 is pulled, the actuating device 56 is carried by the circular body while, at the same time, when the shaft 34 is rotated, the actuating device 56 rotates with the shaft 34 around the circular body of the handle 58.

Figure 4:
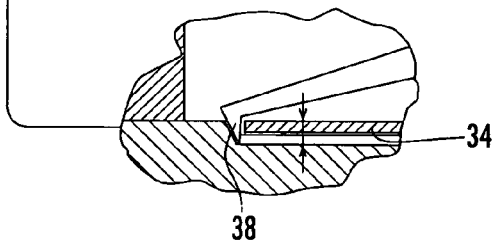
FIG. 4 is substantially a cut-away and close up view showing the activation of the cutting edges.

Thus, when the handle 58 is pulled towards the stop collar 60, the actuating device 56 moves along with the handle 58, the biasing device 66 is stretched, and the mechanical pin 64 contained in the recess 62 defined by the cutter arm 48 is moved toward the actuating device 56. The cutter arm 48 preferably pivots around mechanical pin 54 and causes first component 50*a* to pivot clockwise and first component 50*b* to pivot counterclockwise. The result is that when the actuating mechanism is activated, cutting edges 38*a* and 38*b* are caused to pass through the recess 36 and project out of the drill shaft 34, as indicated by the arrow and as shown in FIG. 4. It can be realized that the cutting edges 38*a* and 38*b* are now in a position to contact the objects introduced to them. An electric drill may be used to rotate the drill shaft 34 and the cutting edges 38*a* and 38*b* to cut an object. For instance, the cutting edges 38*a* and 38*b* may be used to cut a portion of a drum gear that holds the drum to a cartridge thereby allowing the removal of the drum from the cartridge (FIGS. 8 and 9).

Figure 5:
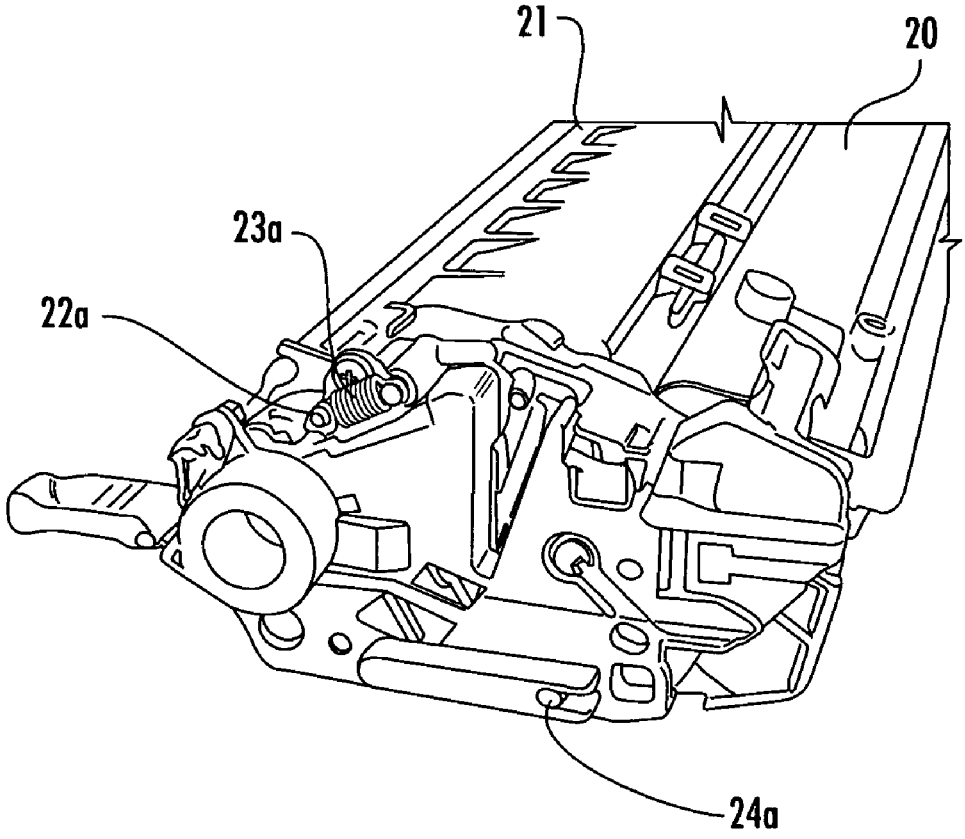
FIG. 5 is substantially a side perspective view of a print toner cartridge for which the cutting tool of the present invention may be used.
Figure 6:
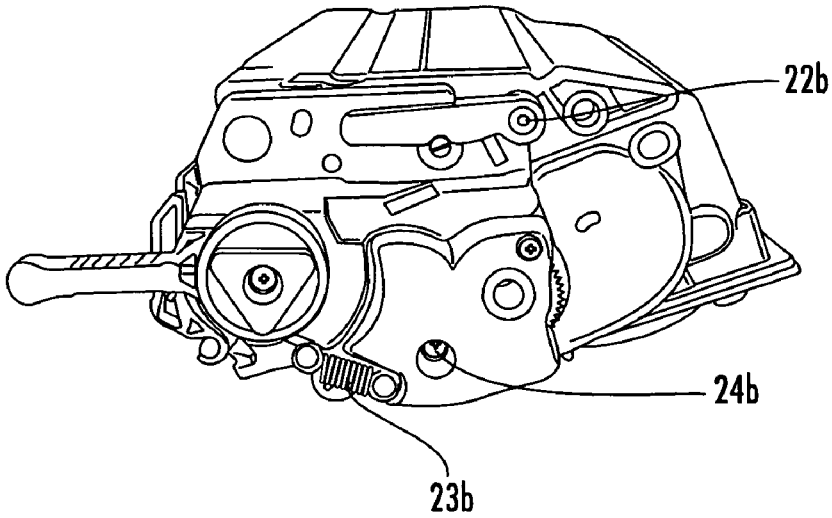
FIG. 6 is substantially another side view of the print toner cartridge shown in FIG. 5.
Figure 7:
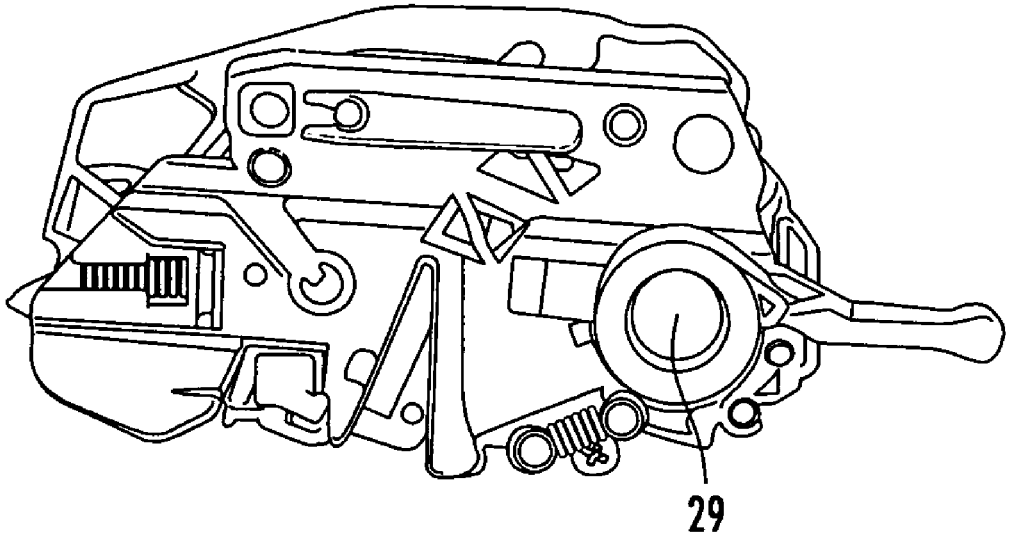
FIG. 7 is substantially another side view of the print toner cartridge shown in FIG. 5 showing a perpendicular wall within a drum gear.

In addition to the various embodiments of the cutting tool 30, the present invention also includes methods of remanufacturing a toner cartridge, which will now be discussed. In the discussion below, laser printer cartridges from Hewlett Packard company having model numbers HP 1600, HP 2600, and HP 2605 are used as examples for ease of description. The methods are by no means limited to the remanufacturing of laser printer cartridges from Hewlett Packard company. The methods may be executed in remanufacturing of cartridges of various types of printers from various companies. As shown in FIGS. 5 and 6, a used toner cartridge typically includes a toner hopper 20, which is usually refilled with toner during remanufacturing and a waste hopper 21, which may be cleaned during remanufacturing. The drum of the used toner cartridge may also need to be replaced. To access the drum, the toner hopper 20 and the waste hopper 21 are preferably separated by detaching the screws 22*a* and 22*b*, springs 23*a* and 23*b*, and pins 24*a* and 24*b*.

In FIGS. 7-11, a typical toner cartridge drum 26 includes a cylindrical body 25 with hollow interior (not shown). The drum typically includes a drum gear 27 configured to be connected to the printer (not shown) and allow the drum the rotate when the printer is in operation. The drum gear may have a cylindrical body 28 and are attached to both ends of the drum body 25. Some drum gears include a gear wall 29 (FIG. 7) positioned perpendicular to the cylindrical body of the drum gear. It can be realized that when the drum gear is attached to the drum and the drum is attached to the cartridge, the gear wall 29 may serve to block access to the hollow interior of the cylindrical drum body. The gear wall 29 may also block access to a gear portion in between the gear wall and the drum.

Figure 8:
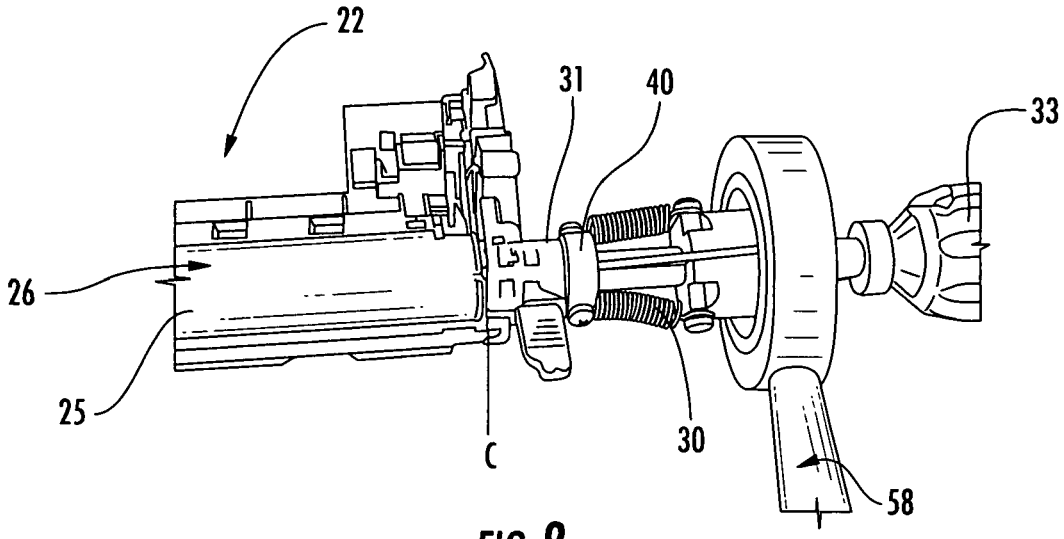
FIG. 8 is substantially a front view of the cutting tool of the present invention being used to remove a drum from the waste hopper.
Figure 9:
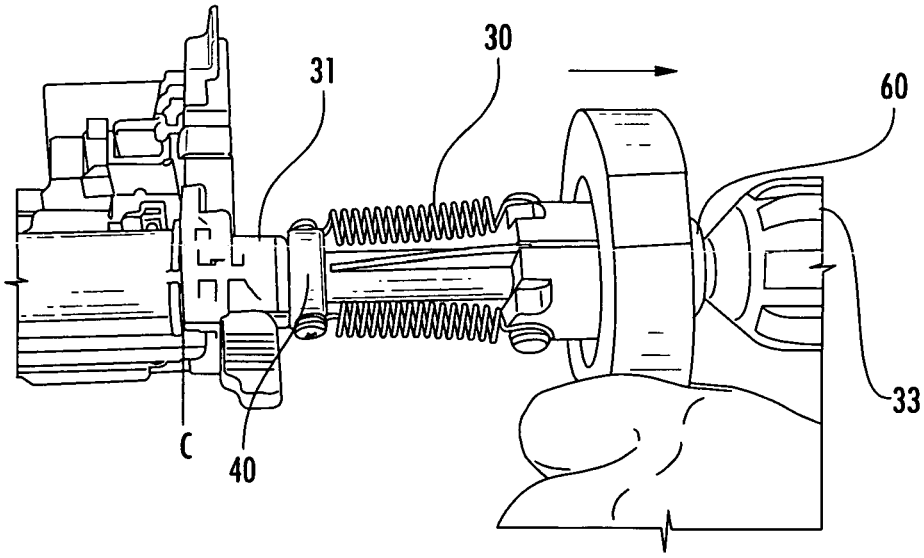
FIG. 9 is substantially a front view of the cutting tool of the present invention being used to remove the drum.

Referring now to FIG. 8, once the toner hopper and the waste hopper are separated, the cutting tool 30 may be used to remove the drum 26 from the cartridge 31. The cutting tool 30 is preferably attached to an electric drill 33. The electric drill 33 preferably allows the drill end 32 of the cutting tool to puncture and enter through the gear wall 29. Once drill end 32 enters through the gear wall 29, the drill shaft 34 also enters through the gear wall and in the hollow interiors of the cylindrical bodies of the gear and the drum. It can be realized that if the drum gear does not have a gear wall, an embodiment of the cutting tool need not include a drill end 32 attached to the drill shaft 34.

Figure 11:
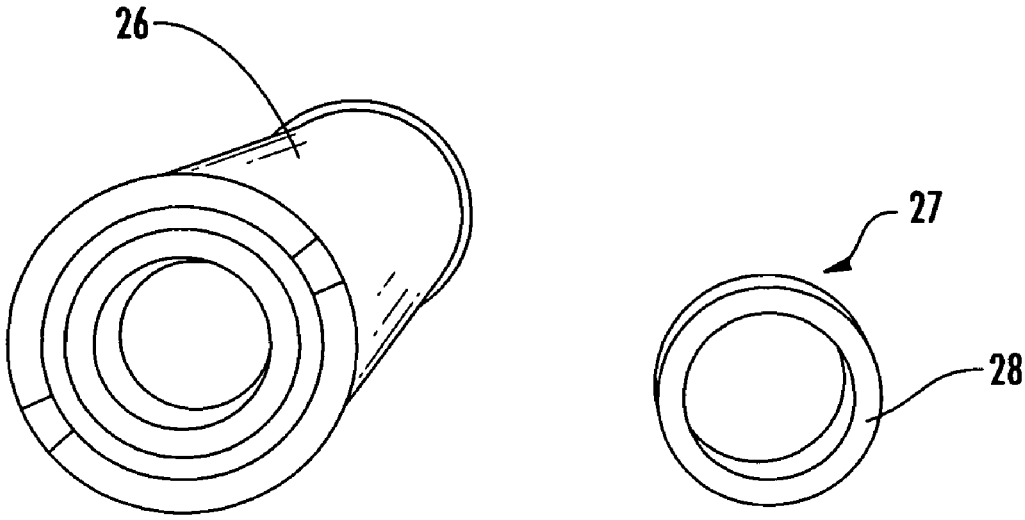
FIG. 11 is substantially a side view of the drum and the drum gear cut apart by the cutting tool of the present invention.

Referring now to FIG. 9, once the drill shaft 34 is inserted through the hollow interior of the drum gear, the stop collar 40 preferably abuts the cartridge portion 31 to prevent further forward motion of the drill end and shaft. The user may activate the actuating mechanism 44 by pulling the handle 30 towards the electric drill 33 while keeping the stop collar 40 abutted to the cartridge portion 31. The user may continue pulling if the handle in the direction indicated preferably until the actuating device 56 abuts the stop collar 60. As the user pulls the handle in the direction indicated, the cutter arm 48*a* preferably pivots clockwise and cutter arm 48*b* preferably pivots counterclockwise (not shown in FIG. 9). The result is that the cutting edges 38*a* and 38*b* are caused to pass through the recess 36 and project out of the drill shaft 34 (not shown in FIG. 9). The cutting edges 38*a* and 38*b* consequently contact the interior wall of the cylindrical body of the drum gear 27. The electric drill preferably rotates the cutting edges 38*a* and 38*b*, which eventually cuts the drum gear 27 at the area indicated by arrow C. The area indicated by arrow C is preferably a gear portion in between the drum body 26 and the cartridge 31. The cut made by the cutting edges 38*a* and 38*b* are preferably around the circumference or the periphery of a gear portion (as shown in FIG. 11).

Figure 10:
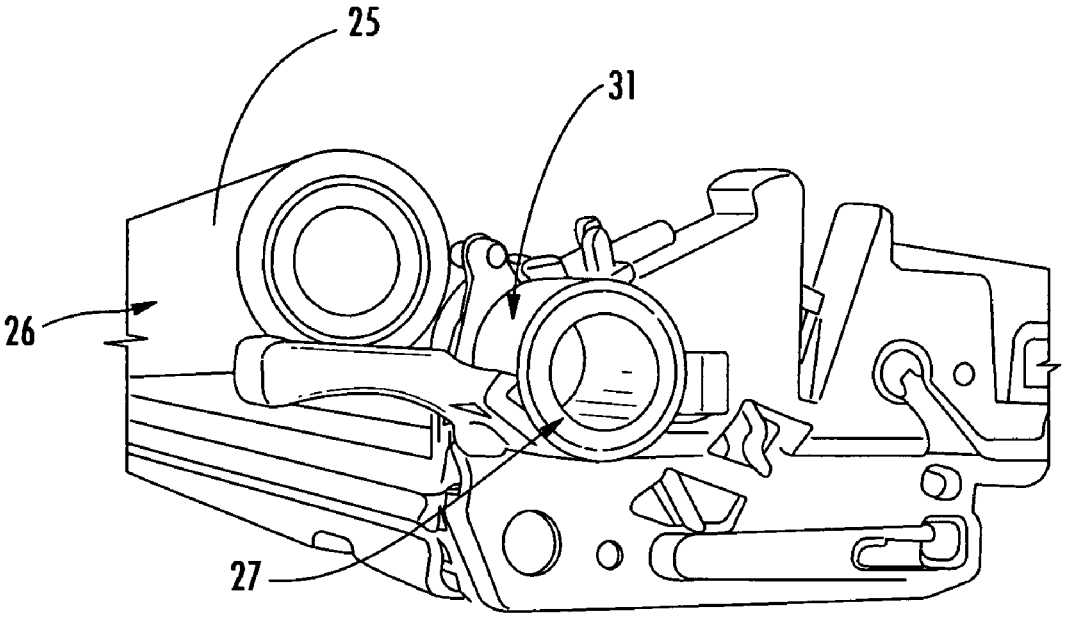
FIG. 10 is substantially a perspective view of the drum substantially detached from the cartridge by the cutting tool of the present invention.

It can be appreciated that, with the present invention, the precision of the location of the area where the cutting edges 38 and 38*b* will make a cut can be attained by adjusting the distance between of the stop collar 40 relative to the cutting edges 38*a* and 38*b*. Referring now to FIGS. 10 and 11, the drum 26 may now be detached from the cartridge 31. It can be appreciated from FIG. 10 that the cutting device 30 of the present invention is able to cut the gear 27 of the drum from the hollow interior of the cylindrical body 28 of the gear and cleanly cut the periphery of the cylindrical body 28 of the drum gear 27 (FIGS. 10 and 11).

It can now be realized that the present invention facilitates the removal of the drum with little or no requirement of having to break any portion of the cartridge 31. This advantage is highly beneficial in the remanufacturing of cartridges, as the appearance of the cartridge is preserved. Additionally, since the removal of the drum by the present invention reduces or avoids having to break any portion of cartridges, the present invention avoids extraneous steps of having to put back broken cartridges. It can further be realized that the present invention provides a new cutting tool and technique for cutting hollow objects from its hollow interior. It can also be realized that the present invention provides a new technique for efficiently removing and replacing a toner cartridge drum, which may be practiced when remanufacturing a previously used toner cartridge.

Although the description above contains many specifications, these should not be construed as limiting the scope of the invention but as merely providing illustrations of some of the presently preferred embodiments of this invention. For example, various mechanical fasteners known in the art may be used in lieu of the mechanical pins described herein. The cutting device may be used for cutting hollow objects from the hollow interior side of the objects other than toner cartridge drums. The shapes of the stop collars and the actuating device may be varied. The shapes and number of cutting edges and cutter arms may be varied. The invention is capable of other embodiments and of being practiced and carried out in various ways. The invention is not limited in its application to the details of the construction and to the arrangement of the components set forth in the above description or as illustrated in the drawings.

What is claimed is:

1. A method of removing a drum from a printer cartridge, the drum comprising a cylindrical body, the drum further comprising a pair of drum gears attached to each end of the drum, at least one drum gear comprising a cylindrical body, the cylindrical body defining a hollow drum gear interior, each drum gear being configured to attach the drum to the printer cartridge, the method comprising:

a. inserting a cutting device trough the hollow drum gear interior;

b. allowing the cutting device to contact the cylindrical body of the drum gear; and c. allowing the cutting device to puncture the cylindrical body of the drum gear.

2. The method of claim 1, wherein the drum gear comprises a drum gear wall that is positioned perpendicular to the cylindrical body and configured to cover the hollow drum gear interior, the method comprising drilling a hole through the drum gear wall.

3. The method of claim 1, wherein the cutting device comprises a pointed edge, the pointed edge comprising a height, the method further comprising adjusting the height of the pointed edge of the cutting device.

4. The method of claim 1 further comprising rotating the cutting device around the hollow drum gear interior.

5. The method of claim 1 further comprising cutting the drum gear in a direction perpendicular to the cylindrical body of the drum gear.

6. The method of claim 1 further comprising allowing a part of the cutting device to abut a portion of printer toner cartridge when the cutting device has been inserted through the hollow drum gear interior at a predetermined distance.

7. A method of removing a drum from a printer cartridge, the drum comprising a cylindrical body, the drum further comprising at least one drum gear attached to one end of the drum, the drum gear being configured to attach the drum to the printer cartridge, the drum gear comprising a cylindrical body, the cylindrical body defining a hollow drum gear interior, the drum gear further comprising a drum gear wall that is positioned perpendicular to the cylindrical body and configured to cover the hollow drum gear interior, the method comprising creating a hole through the drum gear wall and inserting a cutting device through the hollow drum gear interior.

8. The method of claim 7, wherein the cutting device comprises a pointed edge, the pointed edge comprising a height, the method further comprising adjusting the height of the pointed edge of the cutting device.

9. The method of claim 7 further comprising allowing a part of the cutting device to abut a portion of printer toner cartridge when the cutting device has been inserted through the hollow drum gear interior at a predetermined distance.

* * * * *